US008899880B2

(12) United States Patent
Foo et al.

(10) Patent No.: US 8,899,880 B2
(45) Date of Patent: Dec. 2, 2014

(54) STRUCTURE-ASSISTED JACKUP SYSTEM

(71) Applicant: Keppel Offshore & Marine Technology Centre Pte Ltd, Singapore (SG)

(72) Inventors: Kok Seng Foo, Singapore (SG); Michael John Perry, Singapore (SG); Matthew Chin Kau Quah, Singapore (SG); Cynthia Wang, Singapore (SG); Tak On Cheung, Houston, TX (US); Randall Scott Shafer, Houston, TX (US); Peter Noble, Houston, TX (US)

(73) Assignee: Keppel Offshore & Marine Technology Centre Pte Ltd, Singapore (SG)

( * ) Notice: Subject to any disclaimer, the term of this patent is extended or adjusted under 35 U.S.C. 154(b) by 55 days.

(21) Appl. No.: 13/751,157

(22) Filed: Jan. 28, 2013

(65) Prior Publication Data

US 2014/0147215 A1 May 29, 2014

(30) Foreign Application Priority Data

Nov. 23, 2012 (SG) ..... 201208668-2

(51) Int. Cl.
*E02B 17/02* (2006.01)
*E02B 17/08* (2006.01)
*E02B 17/00* (2006.01)

(52) U.S. Cl.
CPC ..... *E02B 17/08* (2013.01); *E02B 17/028* (2013.01); *E02B 17/021* (2013.01); *E02B 17/02* (2013.01); *E02B 2017/0039* (2013.01); *E02B 2017/0043* (2013.01)
USPC ..... 405/196; 405/203

(58) Field of Classification Search
USPC ..... 405/196, 198, 202, 203, 204, 217
See application file for complete search history.

(56) References Cited

U.S. PATENT DOCUMENTS

| | | | | |
|---|---|---|---|---|
| 3,872,679 | A * | 3/1975 | Fischer | 405/200 |
| 4,451,174 | A | 5/1984 | Wetmore | |
| 5,593,250 | A * | 1/1997 | Smith et al. | 405/205 |
| 6,371,695 | B1 * | 4/2002 | Davenport et al. | 405/204 |
| 2010/0221069 | A1 | 9/2010 | Brinkmann et al. | |
| 2012/0247830 | A1 | 10/2012 | Advocaat et al. | |

FOREIGN PATENT DOCUMENTS

| | | | |
|---|---|---|---|
| RU | 2036268 | C1 | 5/1995 |
| WO | WO2012054883 | A1 | 4/2012 |

OTHER PUBLICATIONS

International Search Report of international patent application No. PCT/SG2013/000499 completed and mailed on Feb. 11, 2014 (6 pages).
Written Opinion of international patent application No. PCT/SG2013/000499 completed on Feb. 11, 2014 (4 pages).

* cited by examiner

*Primary Examiner* — David Bagnell
*Assistant Examiner* — Kyle Armstrong
(74) *Attorney, Agent, or Firm* — Pyprus Pte Ltd.

(57) ABSTRACT

The present invention provides a structure-assisted Jackup system comprising a Jackup drilling unit with a main deck structure and a plurality of legs movably coupled with the main deck structure, one or more support base structures disposed on seabed, and a plurality of movable supports, wherein each of the plurality of movable supports is securely coupled with either the main deck structure or one or more support base structure. The present invention also provides a process for assembling the structure-assisted Jackup system.

10 Claims, 7 Drawing Sheets

STRUCTURE-ASSISTED JACKUP SYSTEM

FIELD OF THE INVENTION

The present invention relates generally to jackup systems for offshore deployment, and more particularly to a structure-assisted jackup system suitable for drilling and/or production at offshore locations subject to sea ice.

BACKGROUND OF THE INVENTION

A Jackup system is widely used in offshore exploration for drilling wells and gas/oil production. With the increase of demand of energy, the offshore exploration is moving more and more toward the locations where sea ice or other hazards are present. Therefore, the operability range of a Jackup system is critical for its performance.

The existing options for offshore exploration using current Jackup systems include:

1. Drilling exploration wells from a "normal" Jackup system during ice free season with the riser unprotected;
2. Drilling production wells through a fixed production facility using a "normal" Jackup system during ice free season; and
3. Drilling from a large dedicated drilling platform or combined drilling and production platform designed to resist ice loads all year round.

However, the limitation of exploration to ice free season is not desirable. In addition, the large dedicated drilling platform or combined drilling and production platform designed to resist ice loads is a permanent structure that cannot be easily removed for reuse when the drilling activity is complete. Furthermore, it may not be economical for exploration drilling where only a small number of wells are drilled at a location.

SUMMARY OF THE INVENTION

One objective of this invention is to provide a structure-assisted Jackup system suitable for drilling and/or production at offshore locations subject to sea ice. The structure-assisted system is designed for operation in shallow water up to about 100 m, allowing for the drilling of exploration or production wells using a Jackup drilling unit. Furthermore, the structure-assisted Jackup system is easily removable for reuse once the required wells have been drilled, serving as a cost effective solution for providing production facilities at marginal locations where the cost of development of a dedicated platform may be prohibitive.

One aspect of the present invention provides a structure-assisted Jackup system. In one embodiment, the structure-assisted Jackup system comprises a main deck structure; a plurality of legs movably coupled with the main deck structure, wherein after the structure-assisted Jackup system is assembled, one or more legs provide support (supporting legs) and the remaining legs do not provide support (non-supporting legs); a cantilever disposed upon the main. deck structure; a derrick disposed upon the cantilever; wherein the main deck structure, the plurality of legs, the cantilever and the derrick form a Jackup drilling unit; one or more support base structures disposed on seabed; and a plurality of movable supports, wherein each of the plurality of movable supports is securely coupled with either the main deck structure or the one or more support base structure; so that during the process of the structure-assisted Jackup system is being assembled, the plurality of movable supports is being moved to a position between the main deck structure and the one or more support base structures while the plurality of legs provide support for the Jackup drilling unit, and when the structure-assisted Jackup system is assembled, the one or more support base structures via the movable structure and the supporting legs in combination provide support for the Jackup drilling unit, and the non-supporting legs are retracted. into a position out of water.

In another embodiment of the structure-assisted Jackup system, the support base structure is an ice resistant structure. In a further embodiment of the structure-assisted Jackup system, the ice resistant structure is a caisson.

In another embodiment of the structure-assisted Jackup system, the movable supports are securely coupled to the support base structure.

In another embodiment of the structure-assisted Jackup system, the movable supports are securely coupled to the main deck structure and extend from the main deck structure to the top of the support base structure.

Another aspect of the present invention provides a process for assembling a structure-assisted Jackup system. In one embodiment, the process comprises providing one or more support base structures disposed on seabed; moving a Jackup drilling unit into a position alongside the one or more support base structures, wherein the Jackup drilling unit comprises a main deck structure; a plurality of legs movably coupled with the main deck structure, wherein after the structure-assisted Jackup system is assembled, one or more legs provide support (supporting legs) and the remaining legs do not provide support (non-supporting legs); a cantilever disposed upon the main deck structure; and a derrick disposed upon the cantilever; lowering the plurality of legs into the seabed; lifting the Jackup drilling unit out of the water using the plurality of legs; providing a movable support between the support base structure and the main deck structure so that the movable support provides support to the Jackup drilling unit; and retracting the non-supporting legs out of water.

The objectives and advantages of the invention will become apparent from the following detailed description of preferred embodiments thereof in connection with the accompanying drawings.

BRIEF DESCRIPTION OF THE DRAWINGS

Preferred embodiments according to the present invention will now be described with reference to the Figures, in which like reference numerals denote like elements.

DETAILED DESCRIPTION OF THE INVENTION

Figure 1:
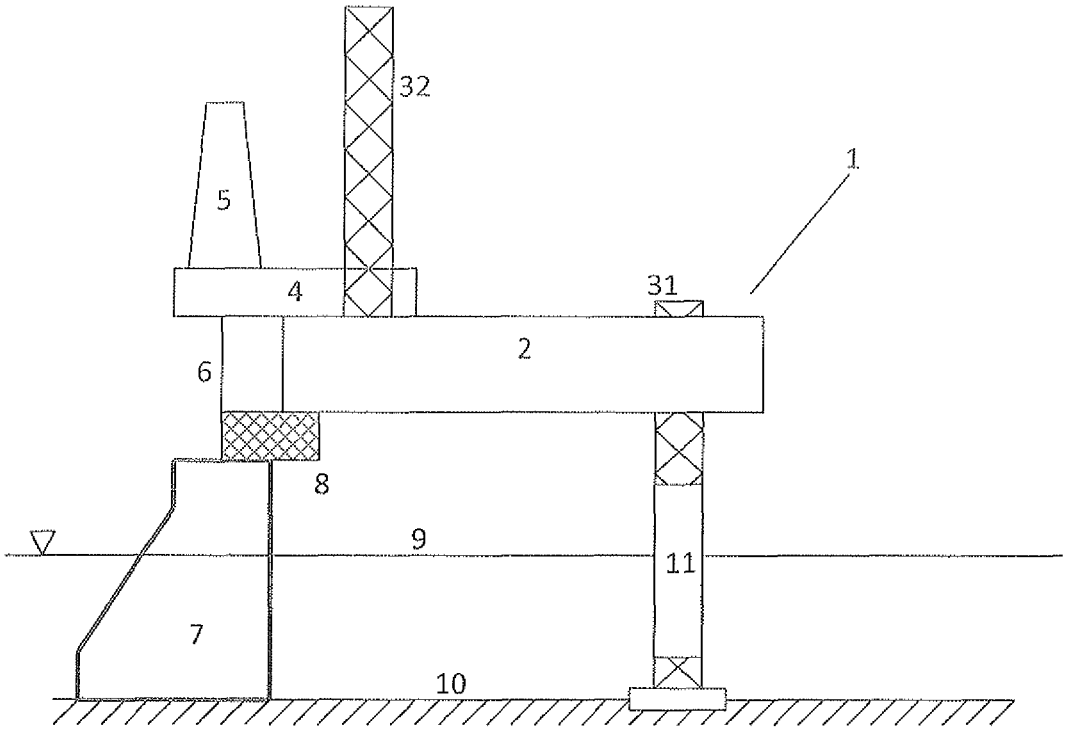
FIG. 1 is a block diagram illustrating an assembled structure-assisted Jackup system in accordance with one embodiment of the present invention.

The present invention may be understood more readily by reference to the following detailed description of certain embodiments of the invention.

Throughout this application, where publications are referenced, the disclosures of these publications are hereby incorporated by reference, in their entireties, into this application in order to more fully describe the state of art to which this invention pertains.

One aspect of the present invention provides a structure-assisted Jackup system suitable for offshore deployment in locations subject to sea ice. Briefly, the structure-assisted Jackup system comprises a Jackup drilling unit with a plurality of legs and one or more support base structures, where the Jackup drilling unit is supported by one or more of the plurality of legs in combination with the one or more support base structures via movable supports. The employment of the support base structures reduces the hazard caused by sea ice to the legs. The support base structure is preferably a steel or concrete caisson supported on the seabed by gravity, piles or suction. Caisson will be used as the exemplary support base structure in the drawings and respective descriptions. However it is to be understood that the support base structure could be others including piled monopods or gravity base structures. The support base structure may additionally serve other purposes such as being a production platform or wellhead platform.

Referring now to FIG. 1, there is provided a block diagram illustrating an assembled structure-assisted Jackup system in accordance with one embodiment of the present invention. The assembled structure-assisted Jackup system 1 comprises a main deck structure 2, a plurality of legs 31, 32 a cantilever structure 4, a derrick 5, a drilling riser 6, one or more support base structures (caisson) 7, and a plurality of movable supports 8. The main deck structure 2, the plurality of legs 31,32, the cantilever structure 4, the derrick 5, and the drilling riser 6 are well known in the art, forming a Jackup drilling unit, where the main deck structure 2 provides support for the cantilever structure 4 which in turn supports the derrick 5, the drilling riser 6 enables the derrick 5 to do the drilling, and the plurality of legs 31,32 are movably coupled with the main deck structure so as to provide the support during the assembly. The one or more support base structures 7 are disposed onto the seabed 10, and the plurality of movable supports 8 are so disposed between the support base structure 7 and the main deck structure 2 that the support base structure 7 provides support to the main deck structure 2. Once the structure-assisted Jackup system is assembled will the main deck structure 2 be above the water line 9, while one or more of the plurality of legs (non-supporting legs) 32 is fully retracted out of the water, and the remaining of the plurality of legs (supporting legs) 31 are disposed into the seabed to provide support in combination with the support base structures. In order to minimize the impact to the legs caused by sea ice, the leg 31 may be provided with an ice protection structure 11 such as plating or an ice breaking cone.

Figure 2:
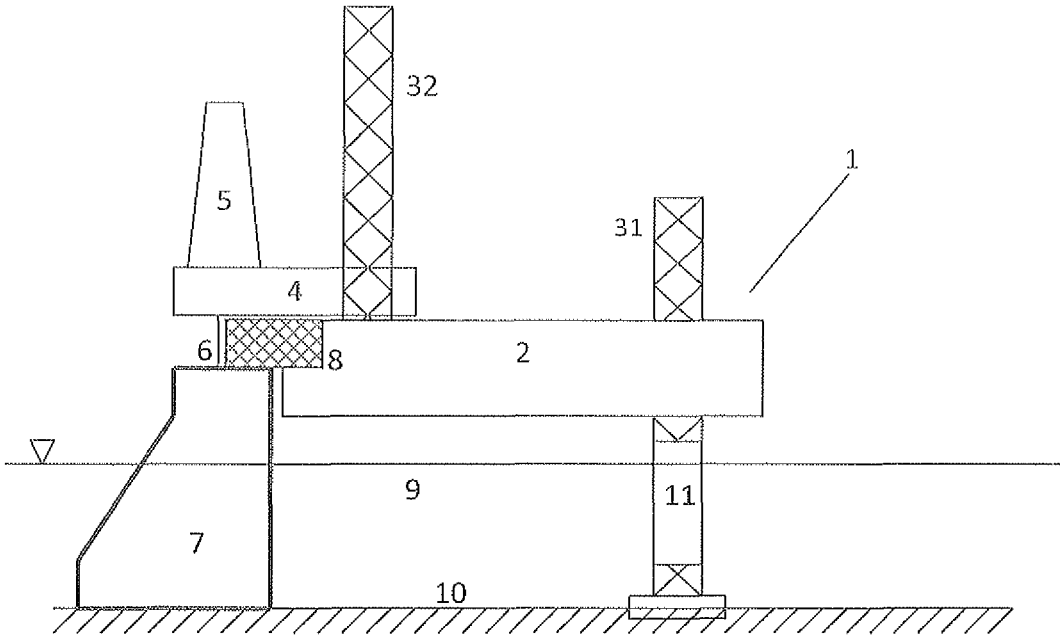
FIG. 2 is a block diagram illustrating an assembled structure-assisted Jackup system in accordance with one embodiment of the present invention.

As shown in FIG. 1, the movable supports 8 are securely coupled to the support base structure (caisson) 7, and skid from a location near the top of the caisson to support the main deck structure 2 from below. As shown in FIG. 2, the movable supports 8 are securely coupled to the main deck structure 2 and extend from the main deck structure 2 to the top of the caisson. The advantage of this is that the mechanical systems needed to move the movable supports 8 into position are housed on the main deck structure 2 and can therefore be reused at different locations. The movable supports would require vertical dimension in the order of several meters and would be movable to extend beyond the edge of the caisson (if supported on the caisson, or edge of the Jackup if supported on jackup).

Figure 3:
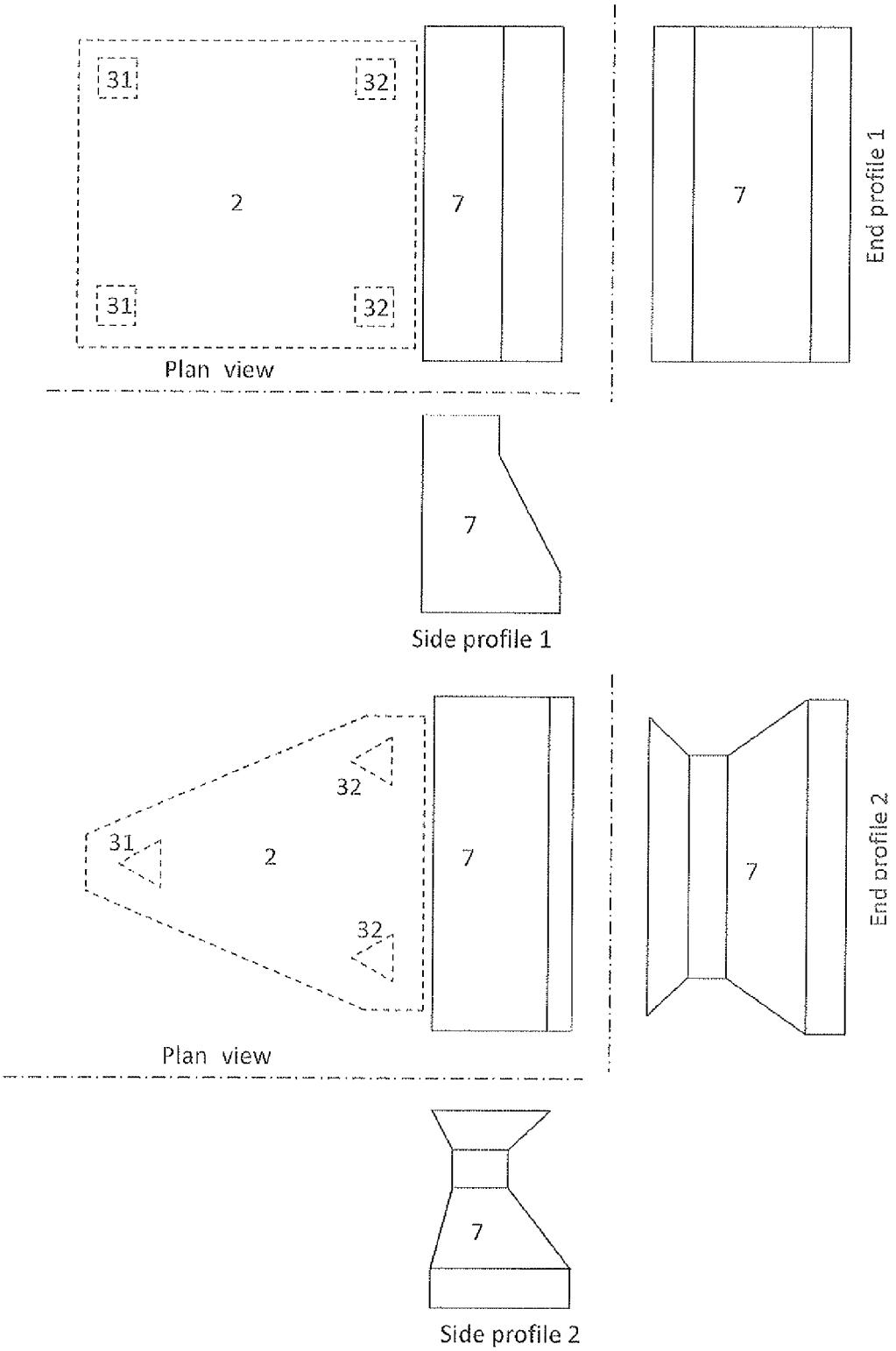
FIG. 3 shows exemplary configurations of the support base structure.

Referring now to FIG. 3, there is provided. exemplary configurations of the support base structure. The configuration of the support base structures can be designed in order to improve the resistance to ice by providing sloped or conical profiles. The arrangements in the structure assisted. Jackup system could vary according to the Jackup design as well as the site water depth and environment. The first example shows a rectangular, four leg Jackup, where a long support base structure is used to support one side of the Jackup. The outer side of the support base structure is sloped here to reduce ice loads on the outer face. The second example shows a triangular, three-leg Jackup, where one support base structure is used to support the Aft side of the Jackup. The support base structure shown in the second example is sloped on all sides to further reduce loads coming from other directions. It is to be understood that many possible support arrangements may be suitable for providing the required support. The configuration, arrangement and number of supporting base structures would be selected based on the characteristics of the site.

Figure 4:
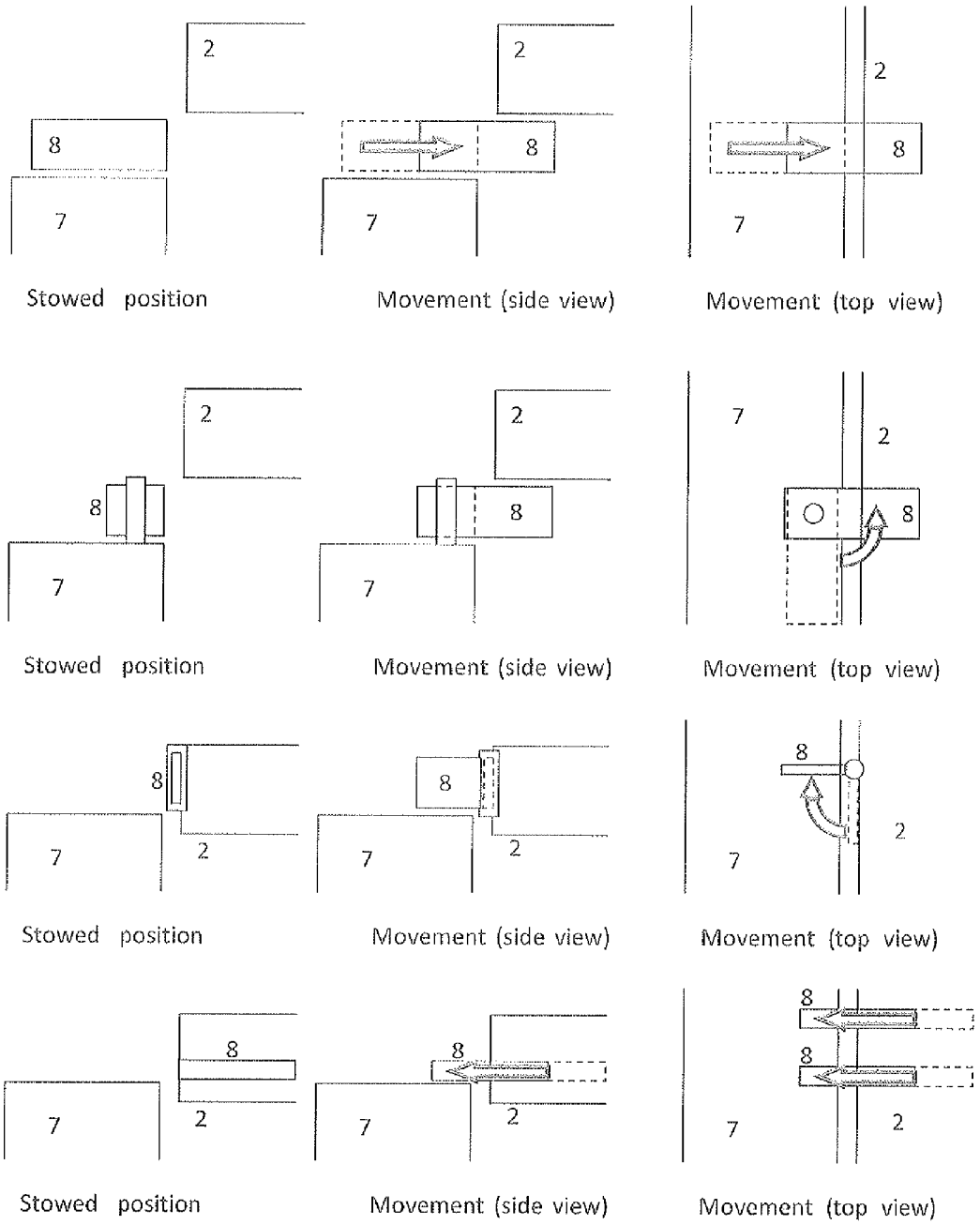
FIG. 4 shows exemplary coupling mechanisms of coupling the movable supports to the support base structures or main deck structures.

Referring now to FIG. 4, there is provided exemplary coupling mechanisms by which the movable supports 8 are so coupled with the support base structure 7 or main deck structure 2 that the movable supports 8 are being moved into positions by sliding, rotating, hinged or pinned connection mechanisms. As shown in the first example, the coupling mechanism is provided on the support base structure (caisson) and the coupled movable support is skidded out in order to support the Jackup in a similar way to the skidding of a Jackup drilling cantilever. As shown in the second example, the coupling mechanism is provided as a rotatable connector pivoted on the support base structure and the movable support is coupled with the rotatable connector in such a way that it may be rotated into position to provide support. As shown in the third example, the coupling mechanism is provided at the side of the main deck structure, whereby the movable support is coupled to the main deck structure, folded alongside the main deck structure when not in use and is rotatable over the support base structure (caisson) in order to provide support. As shown in the fourth example, the coupling mechanism is provided as the receptive chambers and the movable supports are movably coupled with the receptive chambers so that they may be skidded out over the top of the support base structure to provide support for the Jackup unit. The required hold down mechanisms and details are excluded from these figures for clarity of the concept. Other connection types not shown here could also be used to achieve the desired support. For example, the sliding mechanism in the first panel of FIG. 4 could be modified to provide pins that support the main deck structure by engaging openings in the side of the main deck structure rather than supporting it from beneath.

Referring now to FIGS. 5A-5E, there is provided an exemplary sequence of assembling of the structure-assisted Jackup system shown in FIG 1. However it would also be possible to assemble the structure-assisted Jackup system in other ways depending on the final support configuration.

Figure 5A:
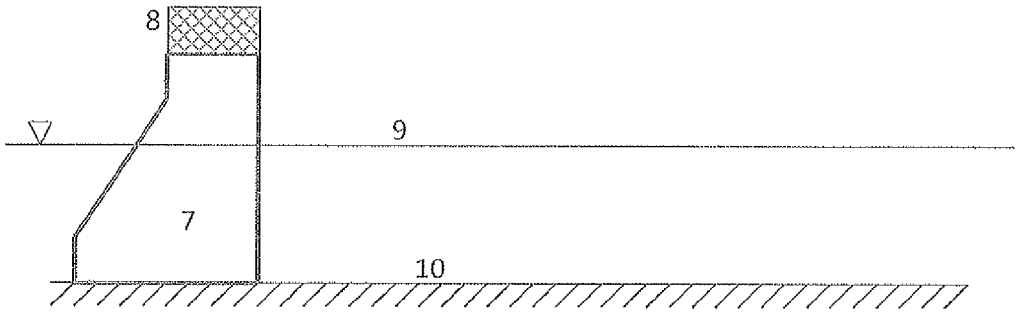
FIGS. 5A-5E show an exemplary sequence of assembling of the structure-assisted Jackup system shown in FIG. 1.

As shown in FIG. 5A, the support base structures 7 are installed in the desired position ready to receive the Jackup drilling unit, where the moveable supports 8 are provided on the top of the support base structures in a retracted position.

Figure 5B:
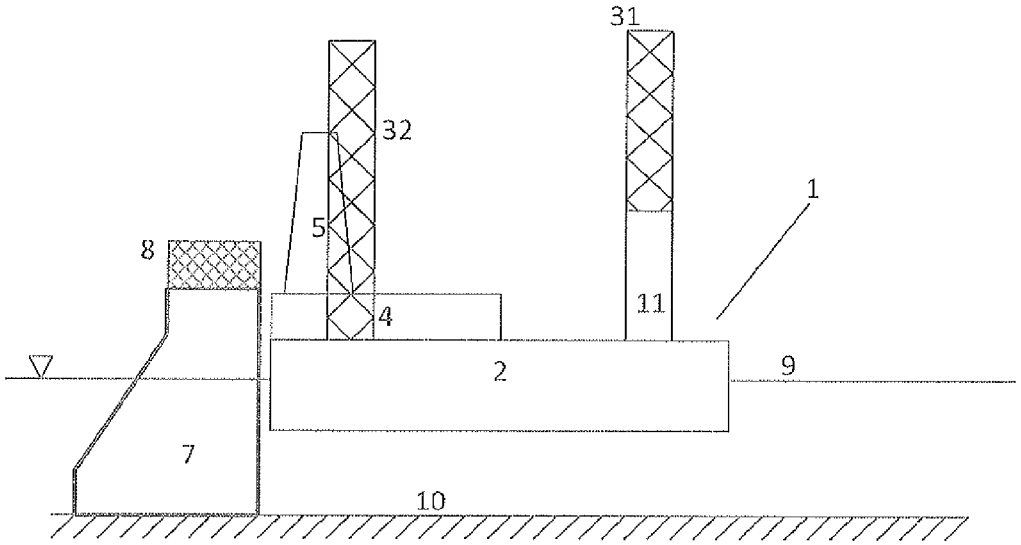

As shown in FIG. 5B, the Jackup drilling unit is being floated into the position alongside the support base structures 7, where the legs 31, 32 are elevated, and the main deck structure 2 is buoyant allowing the Jackup drilling unit to self float. However it is to be understood that the main deck structure may also be supported, for example, on a barge.

Figure 5C:
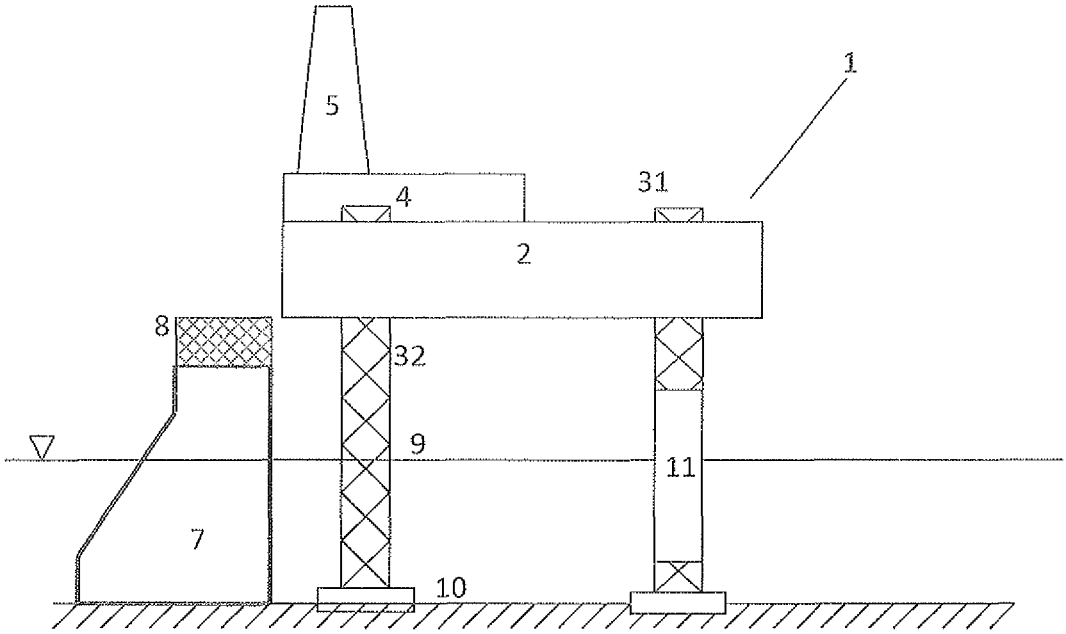

As shown in FIG. 5C, the main deck structure 2 along with supported components is elevated above the support base structures 7 by lowering the legs 31, 32 to the seabed and then lifting the main deck structure to the required elevation using the jackups jacking system.

Figure 5D:
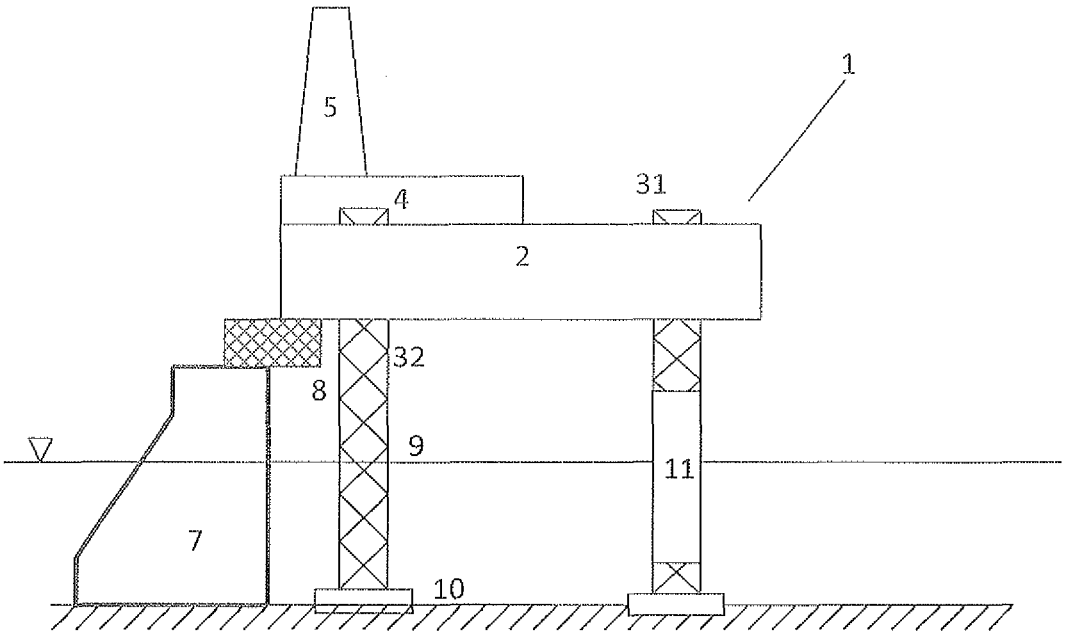

As shown in FIG. 5D, the moveable supports 8 are being moved into the position beneath the main deck structure 2 and secured in place, where the main deck structure is lowered slightly in order to transfer the load to the movable supports.

Figure 5E:
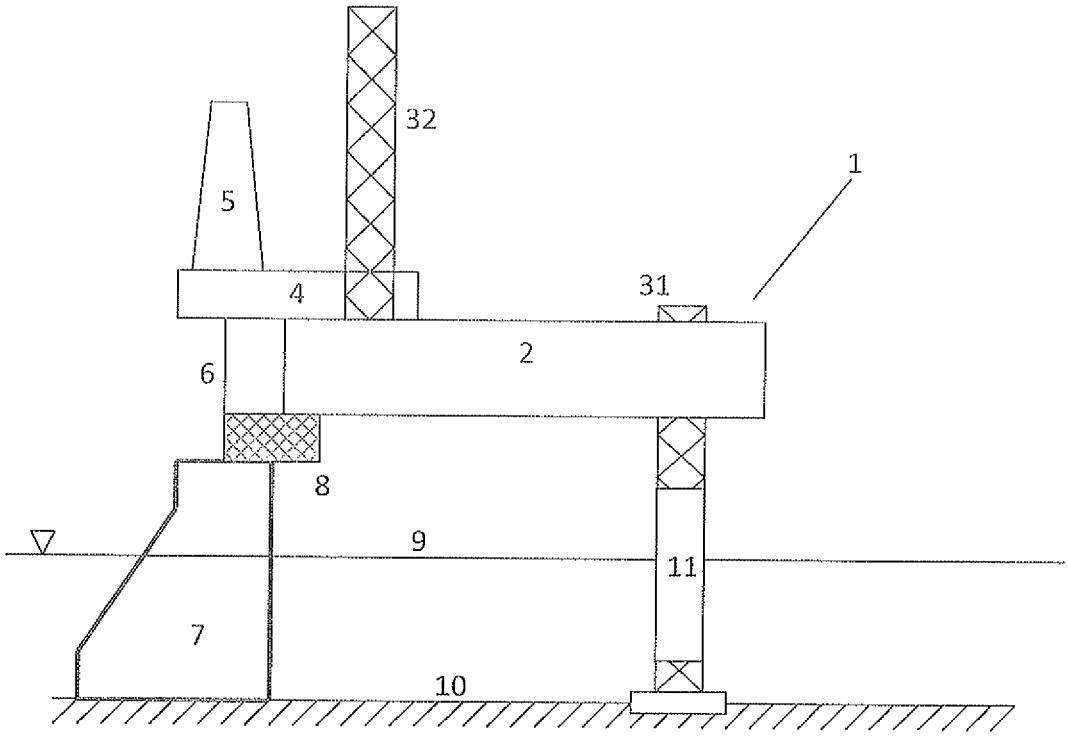

As shown in FIG. 5E, the non-supporting legs 32 are finally elevated and the cantilever (4) skidded out to complete the assembly.

The removal of the Jackup drilling unit can be performed in the opposite sequence to that described above.

While the present invention has been described with reference to particular embodiments, it will be understood that the embodiments are illustrative and that the invention scope is not so limited. Alternative embodiments of the present invention will become apparent to those having ordinary skill in the art to which the present invention pertains. Such alternate embodiments are considered to be encompassed within the scope of the present invention. Accordingly, the scope of the present invention is defined by the appended claims and is supported by the foregoing description.

What is claimed is:

1. A structure-assisted jackup system, comprising:

a main deck structure;

a plurality of legs movably coupled with the main deck structure, wherein during the initial assembly of the structure-assisted jackup system, the plurality of legs are lowered to the seabed so as to lift the main deck structure to a required elevation;

a cantilever disposed upon the main deck structure;

a derrick disposed upon the cantilever; wherein the main deck structure, the plurality of legs, the cantilever and the derrick form a jackup drilling unit;

one or more support base structures disposed on seabed; and a plurality of movable supports, wherein each of the plurality of movable supports is securely coupled with the main deck structure;

wherein during the assembly process of the structure-assisted jackup system the plurality of movable supports extend from the main deck structure to the one or more support base structures so as to allow the one or more support base structures to provide support for the weight of the main deck structure in replacement of one or more of the plurality of legs; wherein the one or more of the plurality of legs replaced by the one or more support base structures are designated as non-weight supporting legs, and the remaining of the plurality of legs not being replaced by the one or more support base structures as weight supporting legs; and wherein after the structure-assisted jackup system is assembled, the non-weight supporting legs are retracted into a position out of water, and the weight supporting legs together with the one or more support base structures via the moveable supports support the main deck structure.

2. The structure-assisted jackup system of claim 1, wherein the one or more support base structures are an ice resistant structure.

3. The structure-assisted jackup system of claim 2, wherein the ice resistant structure is a caisson.

4. The structure-assisted jackup system of claim 1, wherein the movable supports are securely coupled to the one or more support base structures.

5. The structure-assisted jackup system of claim 1, wherein the movable supports are securely coupled to the main deck structure and extend from the main deck structure to a location near the top of the one or more support base structures.

6. A process for assembling a structure-assisted jackup system, said process comprising:

providing one or more support base structures disposed on seabed;

moving a jackup drilling unit into a position alongside the one or more support base structures, wherein the jackup drilling unit comprises a main deck structure;

a plurality of legs movably coupled with the main deck structure;

a cantilever disposed upon the main deck structure; and a derrick disposed upon the cantilever;

lowering the plurality of legs into the seabed;

lifting the jackup drilling unit out of the water using the plurality of legs;

providing a movable support being securely coupled with the main deck structure between the one or more support base structures and the main deck structure so that the one or more support base structures provide support for the weight of the jackup drilling unit in replacement of one or more of the plurality of legs; wherein the one or more of the plurality of legs replaced by the one or more support base structures are designated as non-weight supporting legs, and the remaining of the plurality of legs not being replaced by the one or more support base structures as weight supporting legs; and retracting the non-weight supporting legs out of water.

7. The process of claim 6, wherein the one or more support base structures are an ice resistant structure.

8. The process of claim 7, wherein the ice resistant structure is a caisson.

9. The process of claim 6, wherein the movable supports are securely coupled to the one or more support base structures.

10. The process of claim 6, wherein the movable supports are securely coupled to the main deck structure and extend from the main deck structure to the top of the one or more support base structures.

* * * * *